US010890402B2

(12) United States Patent
Orne et al.

(10) Patent No.: US 10,890,402 B2
(45) Date of Patent: Jan. 12, 2021

(54) FIREARM SUPPRESSOR SYSTEM AND ASSOCIATED QUICK RELEASE MOUNT AND LOCK

(71) Applicant: American Defense Manufacturing, LLC, New Berlin, WI (US)

(72) Inventors: William Orne, New Berlin, WI (US); John Gross, Mukwonago, WI (US)

(73) Assignee: American Defense Manufacturing, LLC, New Berlin, WI (US)

( * ) Notice: Subject to any disclaimer, the term of this patent is extended or adjusted under 35 U.S.C. 154(b) by 0 days.

(21) Appl. No.: 16/255,439

(22) Filed: Jan. 23, 2019

(65) Prior Publication Data

US 2019/0226787 A1 Jul. 25, 2019

Related U.S. Application Data

(60) Provisional application No. 62/620,853, filed on Jan. 23, 2018.

(51) Int. Cl.
*F41A 21/32* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/48; F41A 21/481
USPC ..... 89/14.4; 181/223
See application file for complete search history.

(56) References Cited

U.S. PATENT DOCUMENTS 1,065,341 A * 6/1913 Browning ..... F41A 11/04 42/75.02
2,345,127 A * 3/1944 Kehne ..... F41A 21/481 42/75.02
2,736,119 A * 2/1956 Clarkson et al. ..... F41A 21/12 42/75.02
2,852,983 A * 9/1958 Netzer ..... F41A 21/36 89/14.05
2,935,000 A * 5/1960 Mowrey ..... F41A 21/36 89/14.3
3,202,056 A * 8/1965 Seeberger ..... F41A 21/325 89/14.3
4,893,426 A * 1/1990 Bixler ..... F16B 7/20 403/299
4,920,679 A * 5/1990 Sarles ..... F41A 21/481 42/75.02
5,050,480 A * 9/1991 Knight, Jr. ..... F41A 5/06 42/7
5,271,312 A * 12/1993 Lishness ..... F41A 21/484 42/76.01
5,433,133 A * 7/1995 La France ..... F41A 21/325 89/14.2
5,559,302 A * 9/1996 Latka ..... F41A 21/325 89/14.05

(Continued)

*Primary Examiner* — Derrick R Morgan
(74) *Attorney, Agent, or Firm* — Boyle Fredrickson S.C.

(57) ABSTRACT

A firearm suppressor assembly that includes a quick connect mounting methodology that allows the suppressor to be quickly and repeatably associated with the muzzle end of a firearm. In a preferred embodiment, the mounting methodology includes a plurality of lobes that facilitate less than 90 degree rotation between the muzzle of the firearm and the suppressor and provide a tactile indication of a secured engagement therebetween.

7 Claims, 1 Drawing Sheet

(56) References Cited

U.S. PATENT DOCUMENTS 5,773,746 A * 6/1998 Vaden ..... F41A 21/325 181/223
6,412,389 B2 7/2002 Fluhr
7,353,740 B1 * 4/2008 Hoffman ..... F41A 21/26 42/107
7,676,976 B2 * 3/2010 Dueck ..... F41A 21/30 42/90
7,677,150 B2 * 3/2010 Dater ..... F41A 21/325 89/14.05
7,735,406 B1 * 6/2010 Olson ..... F41A 21/325 89/14.3
7,743,693 B1 6/2010 Brittingham
7,789,009 B1 9/2010 Brittingham
7,832,323 B1 11/2010 Davies
7,891,282 B1 * 2/2011 DeGroat ..... F41A 21/325 181/223
7,905,170 B1 3/2011 Brittingham et al.
7,946,069 B2 5/2011 Dueck et al.
8,091,462 B2 1/2012 Dueck et al.
8,132,352 B2 3/2012 Lippard
8,186,091 B2 5/2012 Mardaga et al.
8,209,895 B2 7/2012 Dueck et al.
8,210,087 B2 7/2012 Latka
8,261,651 B2 9/2012 Casas Salva
8,291,805 B1 * 10/2012 Quilligan ..... F41A 21/325 285/305
8,296,989 B1 * 10/2012 Hawthorne ..... F41A 21/325 403/109.3
8,312,658 B2 11/2012 Lippard
8,333,139 B2 12/2012 Addis
8,387,299 B1 3/2013 Brittingham et al.
8,453,789 B1 6/2013 Honigmann et al.
8,459,405 B1 6/2013 Dueck
8,459,406 B1 6/2013 Dueck
8,499,676 B1 8/2013 Moore et al.
8,505,680 B2 8/2013 Dueck
8,555,765 B2 10/2013 Graham, II et al.
8,567,556 B2 10/2013 Dueck et al.
8,584,794 B2 11/2013 Dueck
8,695,474 B2 4/2014 Overbeek Bloem et al.
8,713,841 B2 5/2014 Lippard
8,714,300 B2 * 5/2014 Johansen ..... F41A 21/325 181/223
8,714,301 B2 5/2014 Shults
8,739,922 B2 6/2014 Wirth et al.
8,763,510 B2 * 7/2014 Dueck ..... F41A 21/26 89/14.4
8,794,376 B2 8/2014 Shults et al.
8,800,359 B2 8/2014 Furch et al.
8,857,307 B2 10/2014 Tresserras Torre et al.
8,910,411 B1 12/2014 Calvert
8,973,481 B2 3/2015 Dueck et al.
8,997,621 B1 4/2015 Dater et al.
9,103,618 B2 8/2015 Daniel et al.
9,109,851 B2 8/2015 Salva
9,121,656 B1 9/2015 McKenzie
9,157,692 B2 10/2015 Salva
9,175,919 B2 11/2015 Russell et al.
9,182,187 B1 11/2015 Griffith
9,222,747 B1 * 12/2015 Morrison ..... F41A 21/325
9,261,317 B2 2/2016 Daniel et al.
9,261,318 B2 2/2016 Wood, Jr. et al.
9,328,984 B2 5/2016 Shults et al.
9,377,263 B1 6/2016 Sy
9,513,078 B1 * 12/2016 Fulton ..... F41A 21/30
9,631,888 B2 * 4/2017 Young ..... F41A 21/325
9,658,019 B2 5/2017 Smith
10,054,382 B2 * 8/2018 Palu ..... F41A 21/30
2001/0049996 A1 * 12/2001 Fluhr ..... F41A 21/30 89/14.4
2003/0019351 A1 * 1/2003 Fluhr ..... F41A 21/30 89/14.4
2012/0279381 A1 * 11/2012 Landolt ..... F41A 21/30 89/14.4
2014/0237881 A1 * 8/2014 Mack ..... F41A 21/325 42/90
2015/0135575 A1 * 5/2015 Wood, Jr. ..... F41A 21/325 42/90
2016/0102935 A1 * 4/2016 Young ..... F41A 21/325 42/76.01
2016/0187093 A1 * 6/2016 Barrett ..... F41A 21/28 89/14.4
2017/0030678 A1 * 2/2017 Rostetter ..... F41C 27/18
2017/0160034 A1 * 6/2017 Parker ..... F41A 21/30
2017/0160035 A1 * 6/2017 Piemme ..... F41A 21/30
2017/0321984 A1 * 11/2017 Palu ..... F41A 21/34
2018/0023914 A1 * 1/2018 Latka ..... F41A 21/30 89/14.4
2018/0172383 A1 * 6/2018 James ..... F41A 21/30
2018/0202758 A1 * 7/2018 Samson ..... F41C 23/16
2018/0245872 A1 * 8/2018 Jen ..... F41A 21/325
2018/0252489 A1 * 9/2018 Parker ..... F41A 21/30
2018/0313628 A1 * 11/2018 Tomczak ..... F41A 21/30
2019/0033030 A1 * 1/2019 Belykov ..... F41A 21/30
2019/0056188 A1 * 2/2019 Miller ..... F41A 5/24
2019/0063859 A1 * 2/2019 Gilpin ..... F41A 21/28
2019/0093973 A1 * 3/2019 Hamby ..... F41A 21/30
2019/0204040 A1 * 7/2019 Mackey ..... F41A 21/481
2019/0316862 A1 * 10/2019 Orne ..... F41A 21/325
2019/0376758 A1 * 12/2019 Tiziani ..... F41A 21/34

* cited by examiner

FIREARM SUPPRESSOR SYSTEM AND ASSOCIATED QUICK RELEASE MOUNT AND LOCK

CROSS REFERENCE TO RELATED PATENTS

This application claims priority to U.S. Provisional Patent Application Ser. No. 62/620,853 filed on Jan. 23, 2018 titled "Firearm Suppressor System and Associated Quick Release Mount and Lock" the disclosure of which is incorporated herein.

BACKGROUND AND SUMMARY OF THE INVENTION

The present invention generally relates to firearms, and more specifically, relates to a firearm sound suppressor assembly configured to muffle the acoustic effect associated with the discharge of the firearm when the suppressor is associated therewith.

The suppressor assembly preferably includes a quick release mount arrangement for attaching the suppressor or silencer to the muzzle of an underlying firearm. The suppressor preferably includes a manually operable lock assembly that mitigates inadvertent separation of the suppressor system from the firearm. In particular, the present invention relates to a suppressor system that incorporates an outer tube housing that contains a series of sound suppressing cone shaped baffles of varying heights with mounting provisions that permit the suppressor system to be mounted directly to a firearm with a muzzle device by inserting the muzzle device of the firearm into the rear of the suppressor system, rotationally engaging lobes on the muzzle device into a cavities in the outer tube housing and activating a locking assembly that is supported by a surface of the outer housing.

Other assemblies, such as U.S. Pat. No. 7,677,150, disclose firearm sound suppressor systems which are constructed to be secured to an underlying firearm via a muzzle mount arrangement that includes provisions consisting of a gate that engages with the rearmost surface of a muzzle device to the hold the suppressor system to the muzzle. Still others, such as U.S. Pat. No. 7,789,009, disclose a mounting arrangement consisting of cavities and locking surfaces that engage wrench flats common to many muzzle devices. A disadvantage of these arrangements can be seen in the fact that the gates and lobe attachments lack a locking assembly and, over a period of operation of the firearm, tend to disengage from the muzzle device through either movement of the gate or rotation of the suppressor about the longitudinal axis of the barrel thereby radially displacing the lobe attachments from the cavities of the suppressor housing. Such disengagement results in an unintentional and potentially hazardous separation of the suppressor system from an underlying firearm.

In particular, in the field of firearm sound suppressor systems, it is of significant advantage to quickly, easily and without the need for tools, install the suppressor system on the firearm to enable employment of the firearm with sound suppression or remove a sound suppressor system from a firearm to facilitate transportation of the firearm or to comply with laws or regulations that do not permit use or possession of a firearm with a sound suppressor system installed.

Another aspect of the present invention is directed to improving the user interaction with the suppressor assembly. In the field of firearm sound suppressor systems, the suppressor system housing can quickly heat with use of the firearm. Commonly, the suppressor heats to temperatures that could burn the user or surrounding materials that may come into contact with the suppressor shortly after use of the firearm for more than only a minimal number of rounds. Accordingly, it would be advantageous to enable operation of the suppressor system mounting and locking features with a gloved hand.

In particular, in the field of firearm sound suppressor systems mounts, fouling generated by shooting the firearm and intrusion of external debris frequently interfere with proper functioning of known firearm sound suppressor system mounts and locks making it highly advantageous to protect the mount and locking component from intrusion by foreign objects through complete containment within the outer tube housing element of the suppressor system.

In particular, in the field of firearm sound suppressor systems, operation of the firearm with the sound suppressor system installed tends to generate forces that cause radial rotation of the suppressor leading to disengagement of the suppressor system mount from the muzzle device of the firearm resulting in a potentially hazardous separation of the suppressor system from the firearm.

One aspect underlying the present invention is therefore to provide a longitudinally translatable and rotational engagement and disengagement mounting arrangement to facilitate expedient association and dissociation of the suppressor assembly relative to the underlying firearm. In a preferred embodiment, the suppressor assembly includes a supported locking assembly that preferably self-engages when the suppressor assembly is secured to the firearm and which is conveniently ambidextrously operable to facilitate removal of the suppressor therefrom.

The present invention provides a firearm sound suppressor system with a novel rotationally operated muzzle device mounting system incorporating a radially operable rotation prevention lock that resolves one or more of the aforementioned drawbacks.

In accordance with another aspect of the invention, there is provided a firearm suppressor system housing comprising a tubular outer housing containing a firearm silence assembly and to which are attach a distal end cap and a proximal end cap.

In accordance with another aspect of the invention, there is provided a firearm silencer assembly comprising a plurality of removable, cylindrical baffles with cone shaped apertures.

In accordance with another aspect of the invention, there is provided a removable distal endcap comprising a housing with an axial bore sized to accommodate a firearm projectile.

In accordance with another aspect of the invention, there is provided a removable proximal endcap housing a firearm muzzle device mount and locking assembly and defining an aperture and central cavity sized to accommodate a firearm muzzle device with the cavity being circumscribed by a plurality of secondary lobe cavities projecting axially from the central cavity and sized to accommodate lugs projecting axially from the outer surface of the muzzle device.

In accordance with another aspect of the invention, there is provided a firearm muzzle device mount element that is selectively securable to a firearm muzzle device by insertion of the firearm muzzle device into the aperture of the proximal end cap of the suppressor system and rotation of the suppressor system to engage the lobe cavities with the muzzle device lugs.

In accordance with another aspect of the invention, there is provided a locking element comprising a locking device supported by the outer housing of the proximal end cap which is selectively moveable and which enables extension and retraction of a spring tensioned locking pin which engages with a channel in one of the muzzle device lugs to prevent axial rotation of the suppressor system and subsequent unintended separation of the suppressor system from the firearm.

In accordance with another aspect of the invention, there is provided a manual operator (actuation bar) that is attached to the spring tensioned locking device and which may be used to displace the locking device from the locked position toward which it is biased by the spring to the unlocked position to permit rotation of the suppressor assembly to disengage the muzzle device lugs from the mounting assembly lobe cavities.

BRIEF DESCRIPTION OF THE DRAWINGS

The accompanying drawings are incorporated into and form a part of the specification and illustrate several aspects of the present invention. These drawings together with the description serve to explain the principles of the invention. The drawings are merely for the purpose of illustrating the preferred and alternative examples of how the invention can be made and used, and are not to be construed as limiting the invention to only the illustrated and described embodiments. Furthermore, several aspects of the embodiments may form—individually or in different combinations—solutions according to the present invention. Further features and advantages will become apparent from the following more particular description of the various embodiments of the invention, as illustrated in the accompanying drawings, in which like reference numbers refer to like elements, and wherein.

DETAILED DESCRIPTION

Figure 1:
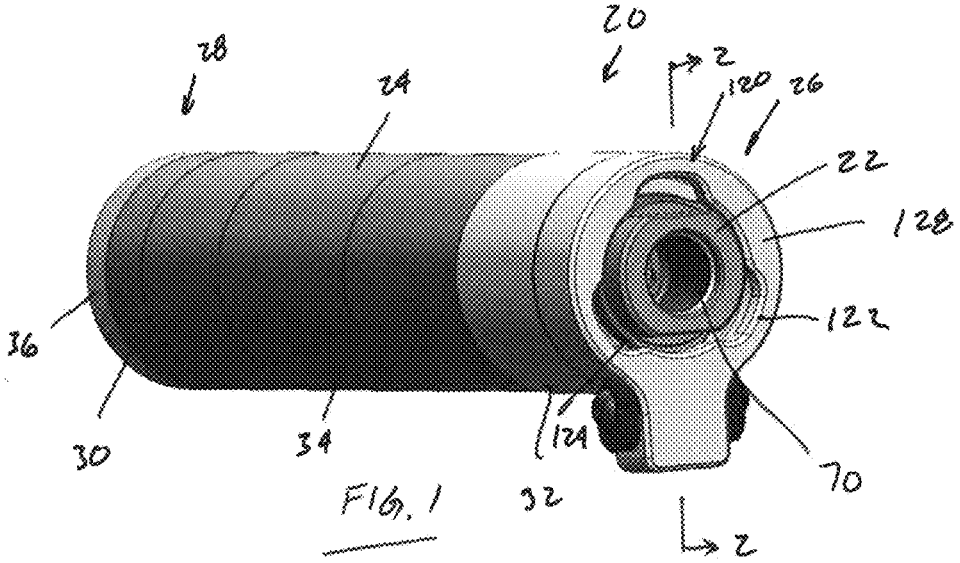
FIG. 1 is a perspective view of a firearm sound suppressor system according to the present invention.
Figure 2:
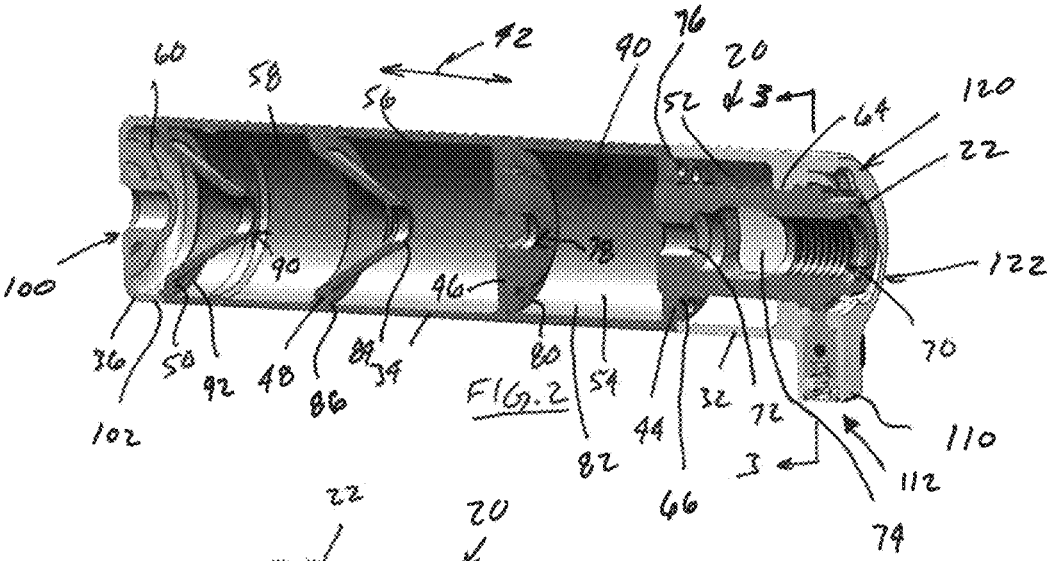
FIG. 2 is a longitudinal perspective cross section view of the firearm sound suppressor system taken along line 2-2 shown in FIG. 1.

FIG. 1 shows a sound suppressor, silencer, or simply suppressor 20 according to the present invention having a muzzle adapter, muzzle break, or simply a muzzle 22 associated with an underlying firearm (not shown) engaged therewith. Suppressor 20 includes a generally elongate body or housing 24 that extends between a first end 26 and a second end 28. First end 26 of housing 24 is constructed to removably cooperate with muzzle 22 secured to an underlying firearm. Second end 28 includes an end cap 30 and defines the discharge end associated with use of an underlying firearm. Referring to FIGS. 1 and 2, housing 24 includes a first portion or mount body 32, a second portion 34, and a third portion 36 generally defined by end cap 30. Although discussed as respective "portions" it is further appreciated that suppressor 20 be provided as a generally unitary body construction.

First portion 32, second portion 34, and third portion 36 of suppressor 20 generally define a chamber 40 that extends in the longitudinal direction, indicated by arrow 42, defined by body 24. One or more baffles 44, 46, 48, 50 are oriented along the longitudinal axis 42 of suppressor 20 and generally spaced from one another so as to define a plurality of respective chambers 52, 54, 56, 58, 60 between respective discrete baffles 44, 46, 48, 50, and/or between muzzle facing baffle 40 and first portion 32 of housing 40, and/or the discharge end facing baffle 50 and end cap 36. Chambers 52, 54, 56, 58, 60 contribute the acoustic muffling of the discharge of a projectile from a firearm associated with suppressor 20.

Referring to FIG. 2, muzzle 22 is constructed to removably cooperate with an interior facing surface 64 of first portion 32 or mount body of suppressor assembly 20. Optionally, muzzle 22 can be constructed to extend to or into and an interior facing surface 66 defined by baffle 44. Muzzle 22 includes a threaded cavity 70 constructed to rotationally cooperate with an underlying firearm. Understandably, other connection methodologies are envisioned for securing muzzle 22 relative to an underlying firearm. Regardless of the firearm connecting methodology employed, as described further below, it is appreciated that muzzle 22 remains secured to an underlying firearm when suppressor assembly 20 is engaged or disengaged therefrom and a radially exterior facing surface of muzzle 22 is constructed to selectively axially and rotationally cooperate with suppressor 20 as described further below.

Muzzle 22 includes a projectile discharge opening 72 associated with an end thereof that is opposite an end of muzzle 22 that cooperates with an underlying firearm. Muzzle 22 can also include one or more optional vents 74 that are fluidly associated with chamber 52. First baffle 44 has a generally planar cross-sectional shape and includes one or more passages 76 that fluidly connect chamber 54 and chamber 52 associated with suppressor assembly 20. Baffle 46 has a somewhat frusto-conical shape and extends between a projectile opening 78 and a radial edge 44 associated therewith and secured to an interior wall 82 second portion 34 of suppressor housing 24.

Baffle 48 is longitudinally spaced relative to baffle 46 and includes a projectile opening 84 and a radial edge 86 that is secured to interior wall 82 of housing 24. Baffle 48 has a more pronounced frusto-conical shape as compared to baffle 46 and baffle 44. Further downstream of baffle 48, relative to the direction of travel associated with a respective projectile, baffle 50 includes a projectile opening 90 and a radial edge 92 that is secured to interior surface 82 of second portion 34 of housing 24. End 36 of suppressor 20 is displaced further downstream relative to muzzle 22 and baffle 58 and includes a projectile opening 100 and a radial or perimeter edge 102 that is secured to second portion 34 of housing 24.

Those skilled in the art will appreciate that projectiles associated with discharge of the firearm associated with muzzle 22 progress sequentially through muzzle 22, through baffle 44, through baffle 46, through baffle 48, through baffle 50, and through end plate 36 relative to a direction of projectile travel. The discrete chambers 52, 54, 56, 58, 60 associated with the offset distances between baffles 44, 46, 48, 50, and end 36 provides suppression of the acoustic signal associated with the discharge of the underlying fire. It is appreciated that respective baffles 44, 46, 48, 50, and end 36 and mount body 32 can be either of permanently affixed to one another or separable and/or replaceable so as to facilitate servicing of suppressor 20 should the need arise. It is further appreciated that one or more of the discrete baffles can be replaced with baffles having other shapes than those shown so as to manipulate the acoustic performance associated with use of suppressor 20. Mount body 32 of suppressor assembly 20 includes a projection portion 110 that supports a securing or locking arrangement 112 associated with selectively securing suppressor assembly 20 relative to a respective underlying firearm in the manner disclosed further below.

Figure 3:
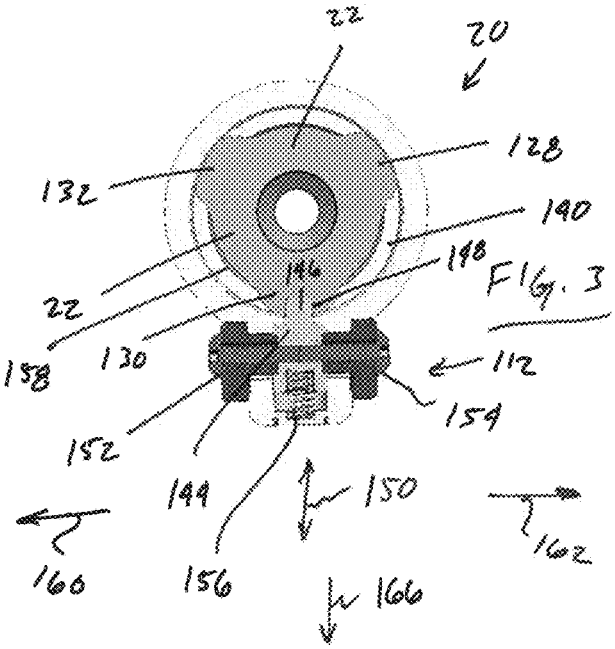
FIG. 3 is a mount end elevational cross section detail view of the mating and locking element of the suppressor system taken along line 3-3—shown in FIG. 3.

Referring to FIGS. 2 and 3, mount body 32 includes a number of cutouts 120, 122, 124 that are oriented radially in an end face 128 of mount body 32. Preferably, cutouts 120, 122, 124 are spaced approximately 120 radial degrees relative to one another and with respect to a circumference associated with muzzle 22. Muzzle 22 includes respective lobes 128, 130, 132 that are shaped to slideably cooperate with respective cutouts 120, 122, 124 so as to facilitate longitudinal translation of suppressor 20 relative to muzzle 22. Once axially slideably associated with one another, rotation of suppressor 20 relative to muzzle 22 associated with an underlying firearm, is facilitated by a radial groove 140 formed in mount body 32 and nearer discharge end of suppressor 20 relative to end face 120 of mount body 32. Groove 140 facilitates rotational translation of suppressor 20 relative to muzzle 22 the facilitate alignment of the discrete lobes 128, 130, 132 of muzzle 22 relative to a lock 144 associated with lock assembly 112. Lock 144 includes a projection 146 that is constructed to removeably cooperate with a cavity 148 associated with one or more of respective lobes 128, 130, 132 defined by muzzle 22.

Lock 144 is translatable in a radial direction, indicated by arrow 150, relative to mount body 32 so as to effectuate selective engagement of projection 146 with cavity 148 associated with a respective lobe 130. Downward lateral translation of a respective operator 152, 154 associated with lock assembly 112 facilitates disengagement of projection 146 from cavity 148 thereby allowing rotation of suppressor 20 relative to muzzle 22. When projection 146 is associated or engaged with cavity 148, lock assembly 112 prevents rotation of suppressor 20 relative to muzzle 22 and thereby prevents dissociation between the suppressor 20 and an underlying firearm until such is desired.

A biasing device 156, such as a spring or the like, biases projection 146 into slidable engagement with an exterior surface 158 of muzzle 22 during rotation of suppressor 20 relative to muzzle 22. Projection of respective operators 152, 154 in the respective outward lateral directions, indicated by arrows 160, 162, facilitates ambidextrous operation associated with the cooperation of suppressor assembly 20 relative to muzzle 22. Further the positive interlocking cooperation between projection 146 and cavity 148 ensures a secure rotationally fixed and longitudinally fixed association between muzzle 22 and suppressor 20 when suppressor 20 is engaged therewith.

To effectuate removal of suppressor 20 from an underlying firearm, user translation of one or both of discrete operators 152, 154 in a downward lateral direction, indicated by arrow 166, or outward radial direction relative to longitudinal axis 42, disengages projection 146 from cavity 148 thereby allowing rotation of suppressor 20 relative to muzzle 22. Upon rotation of the suppressor 22 relative to the muzzle, when a relative rotational orientation is achieved wherein discrete lobes 128, 130, 132 associated with muzzle 22 are aligned with discrete cutouts 120, 122, 124 defined by mount body 32 associated with suppressor 20, axial translation of suppressor 20 relative to muzzle 22 can be initiated which thereby allows the removal of suppressor 20 from the underlying firearm. The limited translation and the robust physical interaction and self-engaging operation of the lock assembly allows suppressor 20 to be repeatedly associated and dissociated from an underlying firearm in a tool less manner and a manner that provides multiple tactile or audible confirmations as to the secure engagement between suppressor 20 and the underlying firearm.

Therefore, one embodiment of the present application includes a firearm suppressor system that includes an outer housing which generally encloses a plurality of baffles and which includes a passage defined therethrough. A distal end cap is associated with the outer housing and associated with the discharge end of a projectile passing through the outer housing. A mount collar is associated with an end of the outer housing generally opposite the distal end cap. The mount collar defines a mounting and locking arrangement associated with securing the suppressor system relative to a firearm. The mounting and locking arrangement includes a plurality of lobes that cooperate with corresponding cavities defined by the mount collar wherein the discrete lobes are greater than 90 radial degrees from another lobe.

Another embodiment of the present invention includes a firearm silencer assembly having an outer housing and a plurality of baffles arranged within the outer housing and which define a projectile passage that is sized to accommodate the passage of a firearm projectile extending through the baffles toward a discharge end of the outer housing. A mount body is secured to one end of the outer housing and defines a tri-lobed mount interface cavity that is configured to receive a muzzle and a radial channel disposed behind the tri-lobed mount interface such that a lobed muzzle engaged with the mount body is rotatable less than 90 radial degrees between a removed and an engaged orientation of the mount body relative to the muzzle.

A further embodiment of the present application discloses a method of forming a firearm suppressor that includes providing a housing having a first end that is selectively securable to a muzzle end of a firearm. A cavity is formed in the first end of the housing and is shaped to receive the muzzle end of a firearm during axial translation of the housing relative to the muzzle end of the firearm and such that the housing has more than two rotational orientations relative to the muzzle end of the firearm capable of allowing the axial translation and such that, when oriented in a longitudinally overlapping orientation relative to the muzzle of the firearm, rotation of the housing less than 90 radial degrees relative to the muzzle of the firearm, effectuates secure engagement between the housing and the muzzle end of the firearm.

These and other aspects, features, and advantages of the present invention may be implemented in a variety of configurations, using certain features or aspects of the embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the claims.

What is claimed is:

1. A firearm suppressor system comprising:

an outer housing that radially encloses a plurality of baffles and which includes a passage defined therethrough;

a distal end cap associated with the outer housing and associated with a discharge end of a projectile passing through the outer housing; and a mount body associated with an end of the outer housing generally opposite the distal end cap, the mount body defining a mounting and locking arrangement associated with securing the suppressor system relative to a firearm, wherein the mounting and locking arrangement includes a plurality of cutouts, a radial channel disposed behind the plurality of cutouts nearer the discharge end, and a projection, wherein a muzzle comprising a plurality of lobes cooperates with corresponding cutouts of the plurality of cutouts and the radial channel, and wherein the projection removeably cooperates with a cavity defined by a lobe of the plurality of lobes and prevents relative rotational and axial translation between the muzzle and the mount body when the projection is engaged with the cavity of the lobe that is rotationally aligned therewith.

2. The firearm suppressor system of claim 1 wherein the outer housing is of uniform diameter and is sized to accommodate the plurality of baffles and such that more than one of the plurality of baffles has a cone shape and the plurality of baffles are separated from the mount body.

3. The firearm suppressor system of claim 1 wherein the distal end cap comprises a cylindrically shaped bore aperture that is centered on a central axis of the distal end cap and that is sized to permit the passage of a projectile therethrough.

4. The firearm suppressor system of claim 1 wherein a rear aperture of the mount body is centered on a longitudinal axis of the outer housing.

5. The firearm suppressor system of claim 1 wherein the mounting and locking arrangement includes operators oriented to be ambidextrously operable when the suppressor system is secured to a firearm.

6. The firearm suppressor system of claim 5 wherein the projection is spring tensioned and biased toward a locked position relative to the mount body.

7. The firearm suppressor system of claim 1 wherein the mounting and locking arrangement is supported by the mount body and includes at least one operator that extends from a bottom portion of the mount body.

* * * * *